United States Patent [19]

Seita et al.

[11] 4,316,781

[45] Feb. 23, 1982

[54] METHOD FOR ELECTROLYZING ALKALI METAL HALIDE

[75] Inventors: Toru Seita; Takao Satoh; Mitsuo Kikuchi, all of Shinnanyo, Japan

[73] Assignee: Toyo Soda Manufacturing Co., Ltd., Shinnanyo, Japan

[21] Appl. No.: 192,543

[22] Filed: Sep. 30, 1980

[30] Foreign Application Priority Data

Oct. 6, 1979 [JP] Japan ..... 54/128469

[51] Int. Cl.[3] ..... C25B 1/34; C25B 13/08

[52] U.S. Cl. ..... 204/98; 204/128; 204/296

[58] Field of Search ..... 204/98, 128, 296

[56] References Cited

U.S. PATENT DOCUMENTS 4,151,053 4/1979 Seko et al. ..... 204/296
4,224,121 9/1980 Dempsey et al. ..... 204/296

FOREIGN PATENT DOCUMENTS 1484612 9/1977 United Kingdom .
1518387 7/1978 United Kingdom .

*Primary Examiner*—R. L. Andrews
*Attorney, Agent, or Firm*—Armstrong, Nikaido, Marmelstein & Kubovcik

[57] ABSTRACT

An improved method for electrolyzing alkali metal halide. Electrolysis is carried out by supplying an aqueous solution of a halide of alkali metal into an anode chamber partitioned by a cation-exchange membrane and water into a cathode chamber to obtain halogen from the anode chamber and hydrogen and alkali hydroxide from the cathode chamber. The cation-exchange membrane is a fluorocarbon polymer membrane which is prepared by arranging one side thereof to have a cation exchange group concentration lower by 10 to 30% within a depth range of 1 to 100μ than that of the other side. The anode chamber is prepared with this side of the membrane which has the lower cation exchange group concentration arranged to face the anode chamber. By this arrangement, a high purity alkali hydroxide can be manufactured at a high rate of decomposition of halide of alkali metal and at a high current efficiency.

5 Claims, No Drawings

METHOD FOR ELECTROLYZING ALKALI METAL HALIDE

BACKGROUND OF THE INVENTION

This invention relates to an electrolyzing method in which a novel cation-exchange membrane is used and electrolysis is carried out by supplying an aqueous solution of an alkali metal halide into an anode chamber and water into a cathode chamber to obtain halogen from the anode chamber and hydrogen and alkali hydroxide from the cathode chamber and more particularly to a method for obtaining a high purity alkali hydroxide at a high rate of decomposition of halide of alkali metal and a high current efficiency through an electrolyzing process carried out with a cation-exchange membrane, which is prepared by arranging one side of a cation-exchange group containing fluorocarbon polymer membrane to have lower concentration of the cation-exchange group than that of the other side thereof within a range of depth from 1 to 100μ and by arranging this side of the membrane which has the lower exchange group concentration to face the anode chamber, which has an alkali metal halide supplied thereto.

Among the conventional diaphragms designed for use in electrolysis of alkali metal halides, there have appeared cation-exchange membranes of a class having a sulfonic acid group as exchange group with a fluorine-containing resin employed as substratum. Typical examples of the cation-exchange membranes of this class include a sulfonic acid type membrane made of a perfluorocarbon polymer which was marketed by Du Pont Co. However, although the membrane is impeccable in terms of durability, the rate of cation transport thereof in an electrolytic solution has not been satisfactory.

Hence, various methods for improvement in this respect have been studied and are still under studies. The following are examples of such methods for improvement:

(1) A method in which the concentration of the exchange group on other side of such a membrane facing a cathode chamber is arranged to be lower than that of the other side facting the anode chamber.

(2) A method in which the exchange group on the side faceing the cathode chamber is arranged to be more weakly acidic than that of the other side facing the anode chamber.

(3) Another method in which a weakly acidic exchange group is employed.

It is well known that the cost of production generally not only varies with power consumption but also greatly varies with the rate of decomposition of the alkali metal halide employed and the concentration of the alkali hydroxide produced. Further, a manufacturing method that enables to produce an alkali hydroxide at a low production cost would be hardly acceptable for industrial purposes if the purity of the alkali hydroxide produced is low. In order to have industrial manufacture efficiently carried out, the balance between the cost of production and the quality of the product must be thoroughly taken into consideration in developing an improved membrane or diaphragm.

With the above stated improved cation-exchange membranes of the prior art employed in carrying out electrolysis to obtain a high purity alkali hydroxide by enhancing the rate of decomposition of the alkali metal halide, however, it has often been experienced that the alkali hydroxide thus obtained has an alkali metal halide mixed therein as well as that the current efficiency is low in the production process.

The present invention has resulted from studies which have been strenuously conducted for the solution of the above stated problems of the prior art.

SUMMARY OF THE INVENTION

It is therefore a general object of the invention to provide a novel method for electrolyzing an alkali metal halide wherein a cation-exchange membrane which is prepared to have concentration of a cation-exchange group on one side of a fluorocarbon polymer membrane containing a cation-exchange group therein arranged to be lower by 10 to 30% than that of the other side thereof within a range of depth of the membrane from 1 to 100μ; the side of the membrane on which concentration of the cation-exchange group is lower is arranged to face an anode chamber; and electrolysis is carried out with an aqueous solution of an alkali metal halide supplied to the anode chamber while water is supplied to a cathode chamber. This invented method is based on a new discovery which has been made by the present inventors from a new point of view.

Although the exact reason why the invented method gives excellent results is not clear, it may be explained in the following manner:

Swelling of the membrane surface on the side of the anode chamber increases according as the rate of decomposition of the alkali metal halide of the anode chamber is higher. This causes the aqueous solution of the alkali metal halide to come into the membrane to result in increasing the water content in the membrane. The increased water content lowers the concentration of fixed ion to result in causing the current efficiency to decrease; which causes the alkali metal halide within the membrane to move to the cathode chamber; and eventually lowers the purity of the alkali hydroxide produced.

Where the side of the membrane facing the cathode chamber is arranged to swell to a very small degree, the difference in swelling between the two sides of the membrane becomes greater and would eventually come to break the membrane. In view of this, the degree of swelling of the side of the membrane facing the anode chamber must be lowered. Further, with the rate of decomposition of the alkali metal halide in the anode chamber arranged to be increased, the concentration of the alkali metal halide tends to decrease, if the concentration of the alkali hydroxide produced is tending to increase, the swelling of the side of the membrane facing the anode chamber becomes greater than the swelling of the other side of the membrane facing the cathode chamber. Then, this tendency comes to bring forth the above stated undesirable results.

In accordance with the invention, the exchange membrane may be selected from fluorocarbon polymer membranes having a sulfonic acid group, a carboxylic acid group or a sulfonamide group in the side chain thereof. For example, a polymer expressed by the following generic formula and made into a film shape may be used:

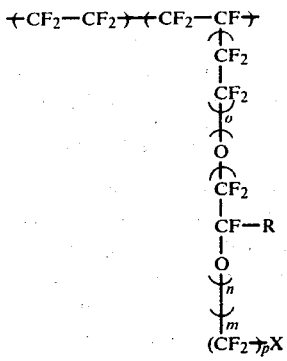

wherein:

R: $-CF_3$, $-CF_2-O-CF_3$ n: 0 or 1-5 m: 0 or 1
O: 0 or 1 P: 1-6
X: $-SO_2F$, $-SO_2Cl$, $-COOR_1$ ($R_1$: 1 to 5 alkyl groups), $-CN$, COF The film, if so desired, may be hydrolyzed before use.

Further, a polymer which is polymerized by adding a third or fourth component to the above stated two-component system may be employed as the ion-exchange membrane. Such a polymer, for example, may be selected out of the following groups A and B and is shaped into a film form and is then subjected to a hydrolyzing process before use:

Group A:

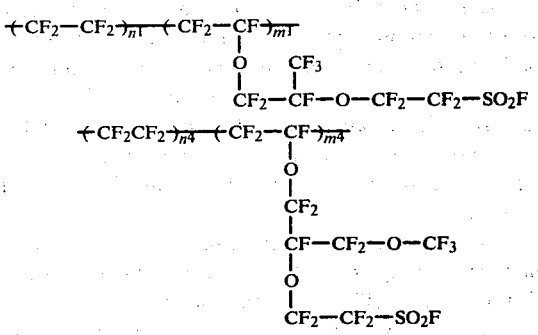

Group B:

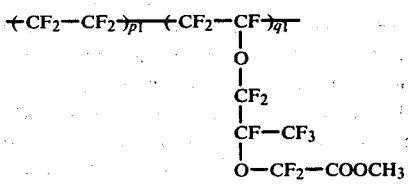

(1)

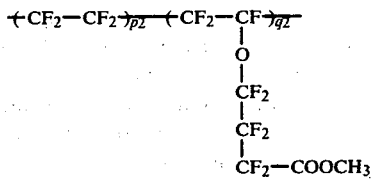

(2)

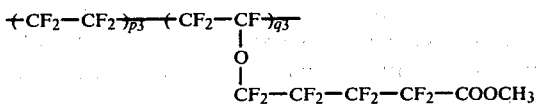

(3)

-continued

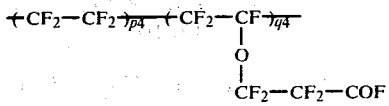

(4)

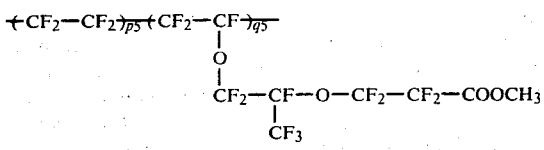

(5)

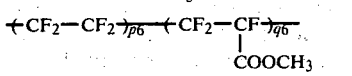

(6)

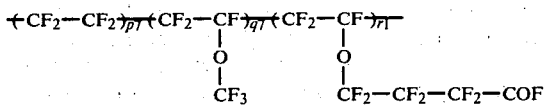

(7)

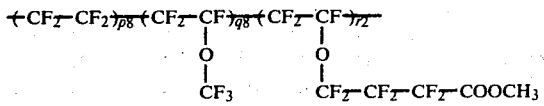

(8)

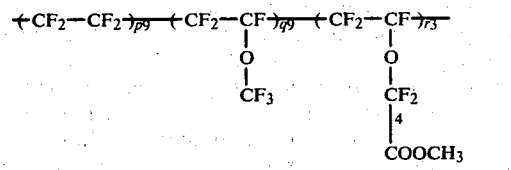

(9)

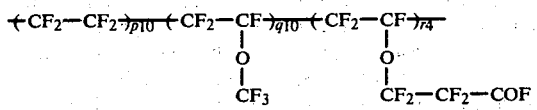

(10)

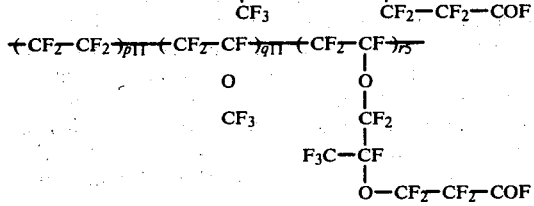

(11)

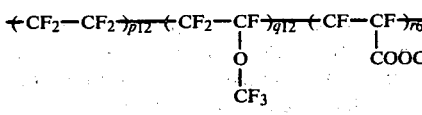

(12)

It is also possible to use a membrane which is obtained from some of the copolymers of Group A shown above and has one side thereof suitably modified with monoamine or di- or poly-amine; a membrane which is obtained from some of the copolymers of Group A and has a carboxylic acid group introduced therein; or a membrane which is prepared by laminating filmy matters made from some of the polymers of the groups A and B together. Each of such polymer membranes is preferably prepared by adjusting the weight of resin containing 1 equivalent of the exchange group to be 500 to 2800 (hereinafter will be expressed as EW=500-2800).

To make the exchange group concentration of one side of the membrane facing the anode chamber less than that of the other side thereof facing the cathode chamber, for example:

a. The exchange group on one side of the membrane facing the anode chamber is first converted into a readily decomposable group such as a sulfonyl chloride group or a carboxylic acid salt and is then removed.

b. Films having different concentrations of the exchange group are laminated together.

c. The side of the membrane facing the anode chamber is prepared by impregnating it with a monomer which does not have any group servable as exchange group or, if necessary, a cross linking agent and then the monomer is polymerized.

However, it is to be understood that such methods have been mentioned above by way of example and the present invention is of course not limited to these methods.

The cation-exchange membrane is normally used with its thickness set at a suitable value between 0.05 mm and 1.5 mm taking the specific conductivity of the membrane and current efficiency into consideration.

In practising the present invention, the electrolytic cell is equipped at least with an anode, a cathode and an external means for allowing a current to flow to the cation-exchange membrane which has undergone the above stated treatment and arranged to divide the electrolytic cell into an anode chamber and a cathode chamber and then to flow between the anode and cathode. With an electrolytic apparatus arranged in this manner, electrolysis is carried out while an aqueous solution of an alkali metal halide is supplied to the anode chamber. In this instance, if necessary, water is supplied to the cathode chamber to adjust the concentration of the alkali hydroxide which is to be taken out from the cathode chamber. The electrolysis is carried out at temperature between room temperature and 100° C. and preferably within a range from 50° to 95° C. The electrolyzing operation is carried out at a current density of 5 to 50 $A/dm^2$. An operation at a current density value exceeding 50 $A/dm^2$ is not always advantageous because the cell voltage then saliently rises.

The aqueous solution of the alkali metal halide is purified before the use thereof in the same manner as in the case of the conventional method for electrolyzing an alkali metal halide. It is particularly desirable that magnesium and calcium are thoroughly removed from the aqueous solution. The concentration of the aqueous solution of the alkali metal halide to be supplied is preferably in a state close to saturation and normally 250 g/l to 350 g/l.

The cathode is made from iron, stainless steel or a material prepared by plating iron with nickel or a nickel compound. The anode is prepared by coating a titanium net with an oxide of a noble metal such as platinum or ruthenium oxide. By employing metal electrodes with a high dimensional stability, these electrode can be spaced as close as several mm to minimize the fall of potential for reduction in power consumption. A suitable spacer may be arranged to prevent the electrode from coming into contact with the membrane.

The above and further objects, features and advantages of the present invention will become apparent from the following detailed description of preferred embodiments. However, it is to be understood that these example are intended to illustrate the invention and are not to be construed to limit the scope of the invention.

DETAILED DESCRIPTION OF PREFERRED EMBODIMENTS

EXAMPLE 1

One side of a film (EW=1150, film thickness 7 mils) made from a copolymer obtained from copolymerization of formulas $CF_2{=}CF_2$ and $$CF_2{=}CF{-}O{-}CF_2{-}\underset{\underset{CF_3}{|}}{CF}{-}O{-}CF_2{-}CF_2{-}SO_2F$$

was brought into contact with ethylene diamine. The surface thereof was thoroughly washed and then was dried. The cross-section of the film was subjected to a coloring test to find that a reaction took place down to a depth of 1.1 mil. Then, after Teflon fiber was introduced into the film thus prepared, the film was heat treated at a temperature between 180° and 200° C. Then, the film was further subjected to a hydrolysis process to make it into a cation-exchange membrane. The cation-exchange membrane thus obtained was further treated with hydrochloric acid to acidify the exchange group of it.

Following that, two sheets of the copolymer film were jointed together with the film-side which had been treated with ethylene diamine disposed inside and were fixed with an acrylic frame to make only the sulfonic acid layer of the joined sheet reactive. The joined membrane thus obtained was then subjected to reaction carried out in a mixture of phosphorus oxychloride and phosphorus pentachloride, which were mixed in the ratio by weight of 1:1, at 120° C. for four hours. After the reaction, the membrane was washed with carbon tetrachloride at 80° C. and dried. The dried membrane was heated at 200° C. for 2 min under pressure of 50 $kg/cm^2$. Through these processes, the exchange group existing within a depth of 10 microns decreased by 12%.

An electrolytic cell having an effective area of $30\times30$ $cm^2$ was formed using the cation-exchange membrane which had been prepared as described in the foregoing as partitioning diaphragm separating an anode chamber and a cathode chamber from each other with the ethylene diamine reaction layer thereof arranged to face the cathode chamber. Saturated brine was supplied to the anode chamber to make exist concentration 200 g/l while water was supplied to the cathode chamber to make the caustic soda concentration at the exit of the cathode chamber 28% by weight. Under this condition, electrolysis was carried out at a current dencity value of 30 $A/dm^2$ and at temperature 80° C. Under a stable operating condition, current efficiency, voltage and the common salt concentration in the aqueous solution of caustic soda were as shown in Table 1 below:

TABLE 1

| Current efficiency | Voltage | Common salt contained in the aqueous solution of caustic soda |
|---|---|---|
| 94% | 3.7V | 13 ppm |

COMPARISON EXAMPLE 1

An electrolytic cell was prepared in the same manner as in Example 1 with the exception of that the cation-exchange membrane which was used as the partitioning diaphragm consisted of only the membrane treated with ethylene diamine. An electrolyzing operation was then carried out under the same conditions as in Example 1 to obtain results as shown in Table 2 below:

TABLE 2

| Current efficiency | Voltage | Common salt contained in the aqueous solution of caustic soda |
|---|---|---|
| 87% | 3.5V | 92 ppm |

EXAMPLE 2

A film (EW=1100, film thickness 10 mils) made from a copolymer obtained from copolymerization of formulas $$CF_2{=}CF{-}O{-}CF_2{-}\underset{\underset{CF_3}{|}}{CF}{-}O{-}CF_2{-}CF_2SO_2F$$

was subjected to a hydrolysis process with a mixture of a 10% aqueous solution of sodium hydroxide and methanol (in the ratio of 1:1 by weight). Then, the exchange group was converted into a sulfonic acid type with nitric acid.

A membrane thus obtained was subjected to a reaction process carried out in a solution of phosphorus oxychloride and phosphorus pentachloride at 120° C. for 50 hours to have the sulfonic acid converted into a sulfonyl chloride group. Two sheets of the membrane were put together and fixed with an acrylic frame. Then only one side of the membrane was subjected to a reaction process carried out in hydriodic acid at 80° C. for 20 hours. Further, the membrane was heated at 200° C. for 2 min under pressure of 50 kg/cm$^2$. In the membrane thus processed, there was produced a carboxylic acid group to an extent of depth of 15 microns on the above stated side while, on the other side, the exchange group decreased by 14% to an extent of depth of 11 microns. Then, the membrane was further hydrolyzed with a mixture solution consisting of a 10% aqueous solution of sodium hydroxide and methanol in the ratio of 1:1 by weight.

With a cation-exchange membrane obtained in this manner, an electrolytic cell having an effective area of 30×30 cm$^2$ was formed using the cation-exchange membrane as partitioning diaphragm separating an anode chamber and a cathode chamber from each other with the carboxylic acid layer thereof arranged to face the cathode chamber. Saturated brine was supplied to the anode chamber to make exit concentration 180 g/l while water was supplied to the cathode chamber to make the caustic soda concentration in the cathode chamber 30% by weight. Under this condition, electrolysis was carried out at a current density of 30 A/dm$^2$ and at temperature 80° C. Current efficiency, voltage and the concentration of common salt in the aqueous solution of caustic soda measured after 30 days were as shown in Table 3 below:

TABLE 3

| Current efficiency | Voltage | Common salt contained in the aqueous solution of caustic soda |
|---|---|---|
| 92% | 3.9V | 12 ppm |

COMPARISON EXAMPLE 2

The same film material that was used in Example 2 was also subjected to the hydrolysis process but was prepared without the heating process which was carried out in the case of Example 2 at 200° C. under the pressure of 50 kg/cm$^2$. Using the membrane thus obtained, electrolysis was carried out in the same manner as in Example 2 to obtain results as shown in Table 4 below:

TABLE 4

| Current efficiency | Voltage | Common salt contained in the aqueous solution of caustic soda |
|---|---|---|
| 88% | 3.8V | 79 ppm |

EXAMPLE 3

A film (EW=850, film thickness 6 mils) which was obtained from copolymerization of formulas of $CF_2{=}CF_2$ and $$CF_2{=}CF{-}O{-}CF_2{-}\underset{\underset{CF_3}{|}}{CF}{-}O{-}CF_2{-}CF_2{-}COOCH_3$$

was subjected to a hydrolysis process.

A membrane which was obtained in this manner was set in a reaction tank which was arranged to allow only one reaction face to be subjected to a reaction process. The membrane was treated with 60 wt% of potassium hydroxide to have 15% of the exchange group thereof removed to extent of 15 microns in depth of the membrane.

Then, electrolysis was carried out in exactly the same manner as in Example 2 with the exception of that the concentration of the caustic soda in the cathode chamber was controlled to be 37% by weight. The results were as shown in Table 5.

TABLE 5

| Current efficiency | Voltage | Common salt contained in the aqueous solution of caustic soda |
|---|---|---|
| 92% | 3.9V | 13 ppm |

COMPARISON EXAMPLE 3

Electrolysis was carried out in exactly the same naner as in Example 3 with the exception of that the exchange group of the membrane employed in this case had not been removed. The results obtained were as shown in Table 6 below:

TABLE 6

| Current efficiency | Voltage | Common salt contained in the aqueous solution of caustic soda |
|---|---|---|
| 88% | 3.8V | 80 ppm |

EXAMPLE 4

A film (EW=1050, film thickness 3 mils) which was obtained from copolymerization of formulas $CF_2{=}CF_2$ and $$CF_2{=}CF{-}O{-}CF_2{-}\underset{\underset{CF_3}{|}}{CF}{-}O{-}CF_2{-}CF_2{-}COOCH_3$$

and another film (EW=1250, film thickness 3 mils) which was obtained from copolymerization of formulas $CF_2{=}CF_2$ and -continued $$CF_2{=}CF{-}O{-}CF_2{-}\underset{\underset{CF_3}{|}}{CF}{-}O{-}CF_2{-}CF_2{-}SO_2F$$

were joined together through a thermal pressure joining process carried out at a temperature at which the two copolymers do not decompose. The membrane which was thus obtained was hydrolyzed with a mixture solution which consisted of a 10% aqueous solution of sodium hydroxide and methanol in the ratio of 1:1 by weight.

Then, with the membrane arranged to have the carboxylic acid group thereof facing the cathode chamber, electrolysis was carried out under the same conditions as in Example 3 to obtain results as shown in Table 7 below:

TABLE 7

| Current efficiency | Voltage | Common salt contained in the aqueous solution of caustic soda |
|---|---|---|
| 97% | 3.7V | 15 ppm |

COMPARISON EXAMPLE 4

A film (EW=1100, film thickness 3 mils) which was obtained from copolymerization of formulas $CF_2{=}CF_2$ and $$CF_2{=}CF{-}O{-}CF_2{-}\underset{\underset{CF_3}{|}}{CF}{-}O{-}CF_2{-}CF_2{-}COOCH_3$$

and another film (EW=1100, film thickness 3 mils) which was obtained from copolymerization of formulas $CF_2{=}CF_2$ and $$CF_2{=}CF{-}O{-}CF_2{-}\underset{\underset{CF_3}{|}}{CF}{-}O{-}CF_2{-}CF_2{-}SO_2F$$

were joined together in the same manner as in Example 4. Hydrolysis was carried out also in the same manner as in Example 4.

An electrolysis operation was carried out under the same condition as in Example 4 to obtain results which were as shown in Table 8 below:

TABLE 8

| Current efficiency | Voltage | Common salt contained in the aqueous solution of caustic soda |
|---|---|---|
| 92% | 3.6V | 90 ppm |

EXAMPLE 5

A film (EW=950, film thickness 6 mils) obtained from copolymerization of formulas $CF_2{=}CF_2$ and $$CF_2{=}CF{-}O{-}CF_2{-}\underset{\underset{CF_3}{|}}{CF}{-}O{-}CF_2{-}CF_2{-}COOCH_3$$

was hydrolyzed with a mixture consisting of a 10% aqueous solution of sodium hydroxide and methanol which were mixed in the ratio of 1:1 by weight.

A cation-exchange membrane was formed and laminated by hot-pressing two sheets of cation-exchange membrane thus obtained. The sealed cation-exchange membrane was placed in an autoclave. Then, ethylene tetrafluoride and azobisisobutyronitrile which was used as initiator were put into the autoclave. Only one side of the cation-exchange membrane was arranged to be impregnated with the ethylene tetrafluoride for polymerization. As a result, the exchange capacity of the membrane decreased by 20% to an extent of 2 mil in depth.

The membrane was set in position with the layer thereof having a higher exchange capacity arranged to face the cathode chamber and an electrolyzing operation was carried out in exactly the same condition as in Example 4 to obtain results as shown in Table 9 below:

TABLE 9

| Current efficiency | Voltage | Common salt contained in the aqueous solution of caustic soda |
|---|---|---|
| 96% | 4.0V | 15 ppm |

COMPARISON EXAMPLE 5

A membrane which was obtained in the same manner as in Example 5 was used without carrying out the ethylene tetrafluoride treatment. An electrolyzing operation was carried out in exactly the same manner as in Example 5 to obtain results as shown in Table 10 below:

TABLE 10

| Current efficiency | Voltage | Common salt contained in the aqueous solution of caustic soda |
|---|---|---|
| 91% | 3.9V | 92 ppm |

What is claimed is:

1. A method for electrolyzing an alkali metal halide wherein the concentration of a cation-exchange group on one side of a fluorocarbon polymer membrane is arranged to be lower than the concentration of the exchange group on the other side of the membrane by 10 to 30% within a depth range from 1 to 100$\mu$; the side having the lower concentration of the exchange group is arranged to face an anode chamber; and electrolysis is carried out with said alkali metal halide supplied to said anode chamber.

2. A method according to claim 1 using a cation-exchange membrane which has said cation-exchange group consist of a sulfonic acid group.

3. A method according to claim 1 using a cation-exchange membrane which has said cation-exchange group consist of a carboxylic acid group.

4. A method according to claim 1 using a cation-exchange membrane which has said cation-exchange group consist of sulfonic acid group and a carboxylic acid group.

5. A method according to claim 1 using a cation-exchange membrane which has said cation-exchange group consist of a sulfonic acid group and a sulfonamide group.

* * * * *

UNITED STATES PATENT AND TRADEMARK OFFICE

CERTIFICATE OF CORRECTION

PATENT NO. : 4,316,781 Page 1 of 3

DATED : February 23, 1982

INVENTOR(S) : SEITA ET AL

It is certified that error appears in the above-identified patent and that said Letters Patent is hereby corrected as shown below:

Col. 3, between lines 39 and 40: please insert the following two formulas:

--

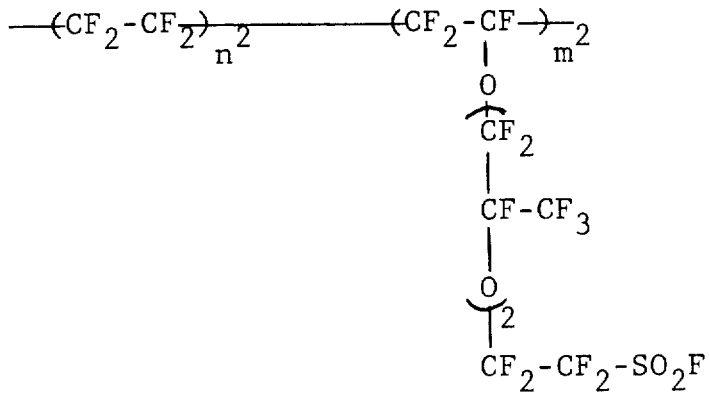

(2)

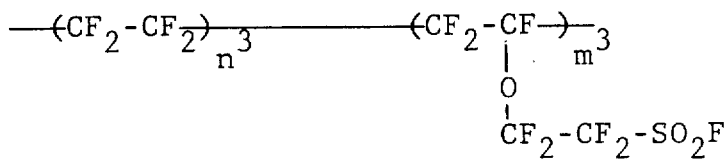

(3)

--.

UNITED STATES PATENT AND TRADEMARK OFFICE

CERTIFICATE OF CORRECTION

PATENT NO. : 4,316,781

DATED : February 23, 1982

INVENTOR(S) : SEITA ET AL

It is certified that error appears in the above-identified patent and that said Letters Patent is hereby corrected as shown below:

Col. 3, between lines 47 and 49: please insert the following formula:

$$\text{---}\left(CF_2\text{-}CF_2\right)_{n^5}\text{---}\left(CF_2\text{-}\underset{\underset{\underset{CF_2\text{-}SO_2F}{|}}{CF_2}}{\underset{|}{CF}}\right)_{m^5} \qquad (5)$$

In formula (11) of column 4: please insert bonds among CF, O and $CF_3$ as indicated below:

$$\begin{array}{c} CF \\ | \\ O \\ | \\ CF_3 \end{array}$$

Column 7, lines 14 and 15: please delete the following formula:

" $CF_2=CF\text{-}O\text{-}CF_2\text{-}\underset{\underset{CF_3}{|}}{CF}\text{-}O\text{-}CF_2\text{-}CF_2SO_2F$ "

and insert the following formula onto lines 13, 14 and 15 therefor: $CF_2=CF_2$ and $$CF_2=CF\text{-}O\text{-}CF_2\text{-}\underset{\underset{CF_3}{|}}{CF}\text{-}O\text{-}CF_2\text{-}CF_2SO_2F$$

UNITED STATES PATENT AND TRADEMARK OFFICE

CERTIFICATE OF CORRECTION

PATENT NO. : 4,316,781 Page 3 of 3

DATED : February 23, 1982

INVENTOR(S) : SEITA ET AL

It is certified that error appears in the above-identified patent and that said Letters Patent is hereby corrected as shown below:

Column 7, line 29: please amend "hydriodic" to --hydrochloric--.

Signed and Sealed this

Eighth Day of June, 1993

*Attest:*

Michael K. Kirk

MICHAEL K. KIRK

*Attesting Officer*

*Acting Commissioner of Patents and Trademarks*